US008564388B2

(12) United States Patent
Hirao et al.

(10) Patent No.: US 8,564,388 B2
(45) Date of Patent: Oct. 22, 2013

(54) RELAY, CONTROL CIRCUIT, AND METHOD FOR CONTROLLING CONTROL CIRCUIT

(75) Inventors: Yuji Hirao, Niigata (JP); Koichi Futsuhara, Niigata (JP)

(73) Assignee: National University Corporation Nagaoka University of Technology, Niigata (JP)

( * ) Notice: Subject to any disclaimer, the term of this patent is extended or adjusted under 35 U.S.C. 154(b) by 0 days.

(21) Appl. No.: 13/641,412

(22) PCT Filed: Apr. 13, 2011

(86) PCT No.: PCT/JP2011/059133
§ 371 (c)(1),
(2), (4) Date: Oct. 15, 2012

(87) PCT Pub. No.: WO2011/129349
PCT Pub. Date: Oct. 20, 2011

(65) Prior Publication Data

US 2013/0033345 A1 Feb. 7, 2013

(30) Foreign Application Priority Data

Apr. 16, 2010 (JP) ..... 2010-095379

(51) Int. Cl.
*H01H 3/00* (2006.01)

(52) U.S. Cl.
USPC ..... 335/185; 335/127

(58) Field of Classification Search
USPC ..... 335/127–129, 185
See application file for complete search history.

(56) References Cited

U.S. PATENT DOCUMENTS

| | | | | |
|---|---|---|---|---|
| 5,831,502 | A * | 11/1998 | Kirsch | 335/129 |
| 6,661,320 | B1 * | 12/2003 | Fausch | 335/129 |
| 6,906,604 | B1 * | 6/2005 | Mader et al. | 335/129 |
| 7,504,915 | B2 * | 3/2009 | Takayama et al. | 335/78 |

FOREIGN PATENT DOCUMENTS

| | | |
|---|---|---|
| JP | 2584399 | 6/1994 |
| JP | H07-070283 | 7/1995 |
| JP | 2003-140702 | 5/2003 |
| WO | WO 2006/006557 | 1/2006 |

OTHER PUBLICATIONS

Japan Patent Office, International Search Report for PCT Application No. PCT/JP2011/059133, mail date May 31, 2011.
The International Bureau, Notification Concerning Submission, Obtention or Transmittal of Priority Document for PCT Application No. PCT/JP2011/059133, mail date May 16, 2011.
The International Bureau, Notification of the Recording of a Change for PCT Application No. PCT/JP2011/059133, mail date Jun. 22, 2011.

* cited by examiner

*Primary Examiner* — Bernard Rojas
(74) *Attorney, Agent, or Firm* — SoCal IP Law Group LLP; Steven C. Sereboff; John E. Gunther

(57) ABSTRACT

The relay (KM) has at least first and second contact points (a1, a2), the states of which are switched from an open state to a close state by the drive of an electromagnet (32). The first and second contact points (a1, a2) switch the states between the open state and the close state by enabling movable contact pieces (31) to move with respect to respective fixed contact pieces (30) by using a power transmission mechanism (21) movable by the drive of the electromagnet (32). The first and second contact points (a1, a2) are set so that the second contact point (a2) is switched to the close state after the first contact point (a1) is switched to the close state and the first contact point (a1) is switched to the open state after the second contact point (a2) is switched to the open state.

4 Claims, 5 Drawing Sheets

(a)

(b)

(a)

(b)

(c)

RELAY, CONTROL CIRCUIT, AND METHOD FOR CONTROLLING CONTROL CIRCUIT

CROSS-REFERENCE TO RELATED APPLICATIONS

The present application is based on and claims priority under 35 U.S.C. §371 to PCT Application No. PCT/JP2011/059133, filed on Apr. 13, 2011, which claims priority to Japanese Patent Application No. 2010-095379, filed on Apr. 16, 2010, the entire contents of which are incorporated by reference herein.

TECHNICAL FIELD

The present invention relates to a relay having a plurality of contacts, a control circuit with the relay, and a method for controlling the control circuit.

BACKGROUND ART

In the related art, a method has been known, which connects contact points of a plurality of relays in series and multiplexes the contacts by considering failures of the contact points to improve operation reliability of an interruption control of an electric circuit.

That is, in an international standard associated with machine safety, a basic safety principle is not to control opening/closing of two contact points at the same timing with respect to two contact points connected in series in order to ensure an interruption control of the electric circuit (ISO 13489-2: 2003). Therefore, two contact points are divided into a contact point applied with an electric load and a contact point which is opened/closed in a no-current state, and even when a welding failure of the contact point occurs at the contact point applied with the electric load, the welding failure is prevented from occurring at the contact point which is opened/closed in the no-current state and the electric circuit is significantly interrupted by the contact point where the welding failure does not occur.

Meanwhile, Patent Documents 1 and 2 disclose a relay that assures that a predetermined contact point is opened when the welding failure occurs at the contact point by coupling an operating member to a contact spring by using a forcing guide contact mechanism. A method example that performs a control for warning or safety after the welding failure of the contact point occurs by using the specific contact point (examination contact point) is also disclosed in Patent Documents 1 and 2.

Further, Patent Documents 1 and 2 illustrate as an embodiment even two contact points in the same relay which are opened/closed at an earlier timing than a check target contact point when the contact point is opened and at a later timing than the check target contact point when the contact point is closed at a contact point operated similarly as a contact point which is the target for checking the welding failure, and disclose an application to a measure for preventing power from being reinput into a motor, and the like. According to the invention disclosed in Patent Documents 1 and 2, safety can be improved by preventing the power from being reinput into various apparatuses when an error occurs. Further, Patent Document 3 proposes the invention associated with application and use of the examination contact point.

Patent Document 1 Japanese Patent Application Publication No. 7-70283

Patent Document 2 Japanese Patent No. 2584399

Patent Document 3 Japanese Patent Application Laid-Open No. 2003-140702

DISCLOSURE OF THE INVENTION

Problems to be Solved by the Invention

However, in the related art, when an operating timing of a contact point is controlled by multiplexing contact points by serial connection, two relays are independently required and one control unit performs a complex timing control or control units need to be individually provided to correspond to the contact points.

That is, in order to more significantly interrupt the circuit when the failure occurs in the contact point of the relay, it is necessary to concentrate an electric load at the time of opening/closing the circuit at a predetermined contact point and control the relay so that an operating order of other contact points is constant so as to open/close the contact points in a no-current state at all times. However, a complicated circuit is required to control the operating timing of the relay and even when a control circuit breaks down, it is difficult to implement a circuit that assures a just operating timing.

Further, in the relay of the forcing guide contact mechanism disclosed in Patent Documents 1 and 2, it is possible to perform a timing control of the contact points which are connected in series when two contact points are adopted in the same relay, of which operating timings are different. However, when the contact point concentrated with the electric load is welded while opening/closing, it is difficult to interrupt an electric circuit at other contact points from a structure of the relay.

Further, even when two relays of the forcing guide contact mechanism disclosed in Patent Documents 1 and 2 are independently used and the contact points are connected in series, the same situation as the description of Paragraph No. 0008 occurs.

Meanwhile, in the relay of the forcing guide contact mechanism disclosed in Patent Documents 1 and 2, since the failure of the contact point welding may be detected by the examination contact point, it is possible to deal with the failure based on a safety countermeasure while restarting as described above. However, in a case in which power is emergently interrupted when the error occurs, a contact error of the relay is detected while restarting or other means for detecting the contact error is required, and as a result, the circuit is not instantaneously interrupted when the error occurs.

An object of the present invention is to provide a relay capable of significantly interrupt a circuit even when a welding failure occurs at a contact point by operating a plurality of contact points at respective desired timings through driving one electromagnet without a complicated control or a control unit corresponding to the contact point, a control circuit with the relay, and a method for controlling the control circuit.

Means for Solving the Problems

A relay according to the present invention, which is contrived to consider the problem, includes: first and second contact points respectively by a fixed contact piece and a movable contact piece; an electromagnet; a power transmission mechanism operated by the electromagnet to operate the movable contact pieces of the first and second contact points; and a spring pressing the power transmission mechanism and operating the power transmission mechanism in an opposite direction to an operating direction by the electromagnet, wherein the power transmission mechanism includes a first press portion operated by driving the electromagnet to contact the movable contact piece of the first contact point and operate the movable contact piece of the first contact point, and a second press portion formed by a different member from the first press portion and operated by driving the electromagnet to contact the movable contact piece of the second contact point and operate the movable contact piece of the second contact point, and in the case of the first and second contact points, by setting an interval between a portion of the press portion which contacts the movable contact piece and the fixed contact piece to be larger at the second contact point side, the first and second press portions are operated by the electromagnet to close the first contact point and thereafter, close the second contact point, and the first and second press portions are operated by the spring to open the second contact point and thereafter, open the first contact point.

The relay configured as above may operate the first and second contact points in a desired order by driving one electromagnet. As a result, two independent relays were required in the related art, but in the relay of the present invention, one relay may be used. Accordingly, a configuration depending on various controls may be simplified as compared with the related art and reliability may be ensured. That is, when the first and second contact points are connected to each other in series, occurrence of an error by welding of the contact point may be concentrated on the second contact point and further, an error of the second contact point may be complemented by the first contact point while ensuring redundancy.

Further, the power transmission mechanism is formed by the first and second press portions depending on the first and second contact points, and as a result, the first contact point may be controlled without an influence from the welding even when the second contact point is welded. Therefore, the error of the second contact point by the welding of the contact point may be significantly complemented in the first contact point, and safety may be ensured. That is, in the configurations disclosed in Patent Documents 1 and 2, when the power transmission mechanism is integrally prepared in the first and second contact points, it is difficult to control the other contact point by the welding of one contact point. However, when the power transmission mechanism is formed by the first and second press portions depending on the first and second contact points, the first contact point may be controlled with no influence even when the second contact point is welded.

The relay further includes a third contact point by a fixed contact piece and a movable contact piece, wherein the second press portion sets the third contact point to be closed when the second contact point is opened and sets the third contact point to be opened when the second contact point is opened by operating the movable contact piece depending on the third contact point, to hold the third contact point to be opened when the second contact point is welded.

In the relay configured as above, since the third contact point is operated to correspond to the second contact point, a failure of the second contact point may be detected by using the third contact point.

In a control circuit using a relay, the relay is the aforementioned relay and the control circuit is allocated to the control of the control target.

The control circuit configured as above may provide a circuit considering contact point welding. In the relay, a plurality of contact points may be operated at different timings by driving one electromagnet and a control burden may be reduced.

Further, in a method for controlling a control circuit which controls a control target by controlling a relay by a control unit, the relay is the aforementioned relay and a method for controlling a control circuit which controls a control target is allocated to the control of the control target.

The circuit considering the contact point welding may be controlled by using the method for controlling the control circuit configured as above. Further, a processing burden of the control circuit may be reduced.

Effects of the Invention

According to the present invention, it is possible to implement a relay that can significantly interrupt the circuit even when the welding failure occurs in the contact point by operating the plurality of contact points at desired timings, respectively by driving one electromagnet without the complicated control or the control unit corresponding to the contact point.

Further, when an application control circuit is configured by using the relay according to the present invention, the number of the relays or the electromagnetic contactors required in overall may be reduced and the configuration may be simplified, in that instead of two relays required in the related art, only one relay may be used.

PREFERRED MODE FOR CARRYING OUT THE INVENTION

Hereinafter, an embodiment of a relay according to the present invention will be described with reference to FIGS. 1 to 5.

The relay according to the present invention switches ON and OFF of a power supply to an operation target (a machine 1 to be described below in the embodiment) in a safety operating system S to be described below, and controls an operable state and a stop state of the operation target. Further, the relay may be capable of controlling the supply of a power to the operation target and is a concept including a contactor, a switch, and a relay.

Further, hereinafter, an example in which the relay according to the present invention is applied to an electromagnetic relay or an electromagnetic contactor will be described.

First, an overview of the safety operating system S to which the relay according to the present invention is applicable will be described.

The safety operating system S is a system in order for a person to safely operate the machine 1. In the safety operating system S, the operation of the machine 1 is configured to be stopped, for example, when it is judged that the person is in a danger state or when the person is within an operation range of the machine 1, in order for the person to safely operate the machine 1.

Figure 1:
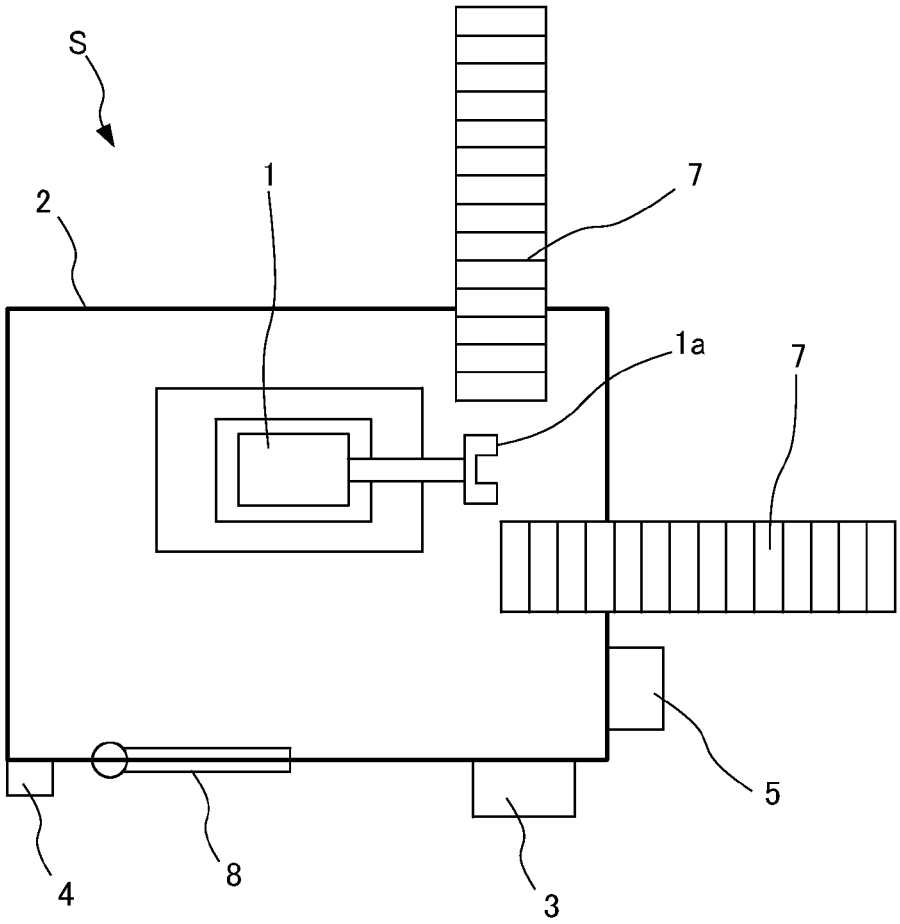
FIG. 1 is a diagram illustrating a safety operating system, (a) is a diagram illustrating an overview of the safety operating system, and (b) is a diagram illustrating an opening/closing detecting mechanism of a door.
Figure 1:
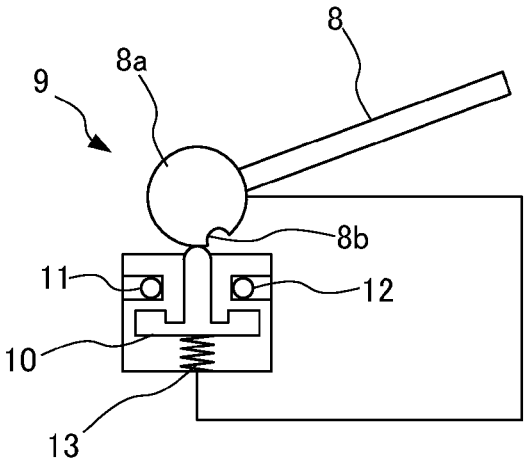

The safety operating system S includes, in detail, the machine 1 as the operation target, a safety fence 2, an operation control panel 3, an emergency stop switch 4, and a safety relay module 5, as illustrated in FIG. 1(*a*).

The machine 1 includes an operating arm 1*a* that is operated within a predetermined operating range. The machine 1 performs operations including, for example, assembling a product that flows on one belt conveyor 7 by using the operating arm 1*a*, loading the product on the other belt conveyor 7, and the like, as illustrated in FIG. 1(*a*).

The safety fence 2 is provided to surround the operating range of the machine 1. A door 8 for the person to go in and out within the operating range of the machine 1 is provided in the safety fence 2 for maintenance of the machine 1, and the like. An opening/closing detecting mechanism 9 detecting opening/closing of the door 8 is provided in the door 8. The opening/closing detecting mechanism 9 will be described below.

The operation control panel 3 which is used for the person to operate the machine 1 is configured by an operation button (not illustrated), and the like.

The emergency stop switch 4 is configured such that the person presses the switch to stop the operation of the machine 1.

The safety relay module 5 has a plurality of electromagnetic relays or electromagnetic contactors mounted thereon. The safety relay module 5 is connected with the machine 1, the opening/closing detecting mechanism 9, and the operation control panel 3.

Subsequently, the opening/closing detecting mechanism 9 of the door 8 will be described by using FIG. 1(*b*).

The opening/closing detecting mechanism 9 of the door 8 detects an electric conduction state to detect an opening/closing state of the door 8. The opening/closing detecting mechanism 9 of the door 8 is configured by a structure provided in a shaft portion 8*a* of the door 8 and the safety fence 2 which contacts the shaft portion 8*a* of the door 8.

A concave portion 8*b* is provided at a position of the shaft portion 8*a* of the door 8 corresponding to a closed state of the door 8 so that a plunger 10 protrudes with the door 8 being closed.

The metallic plunger 10, a metallic spring 13 pressing the plunger 10 toward the shaft portion 8*a* of the door 8, and electric contact points 11 and 12 contacting the plunger 10 while the plunger 10 protrudes are provided in the safety fence 2 corresponding to the shaft portion of the door 8.

In the opening/closing detecting mechanism 9 of the door 8 configured as above, since the concave portion 8*b* is positioned opposite to the plunger 10 while the door 8 is closed, the plunger 10 protrudes in the concave portion 8*b*.

In the opening/closing detecting mechanism 9 of the door 8, the plunger 10 protrudes by pressing force of the spring 13, and as a result, the plunger 10 contacts the electric contact points 11 and 12. In the opening/closing detecting mechanism 9 of the door 8, the plunger 10 contacts the electric contact points 11 and 12, and as a result, parts of the electric contact points 11 and 12 are electrically configured.

Meanwhile, when the door 8 is opened, since the plunger 10 contacts a portion other than the concave portion 8*b* of the door 8, and thus the plunger 10 is pressed against the pressing force of the spring 13, the plunger 10 does not protrude. As a result, in the opening/closing detecting mechanism 9 of the door 8, since the plunger 10 does not contact the electric contact points 11 and 12, the electric contact points 11 and 12, the shaft portion 8*a* of the door 8, the spring 13, and the plunger 10 are not electrically conducted with each other.

The opening/closing detecting mechanism 9 of the door 8 detects a closed state of the door 8 when detecting the electric conduction state and detects an opened state of the door 8 when detecting a non-electric conduction state.

The safety operating system S switches apparatuses (electromagnetic relays R1, R2, and Rh in the embodiment or electromagnetic contactors KM1 and KM2) based on an opening/closing state of the door 8 detected by the opening/closing detecting mechanism 9 of the door 8. In addition, states of the apparatuses satisfy a predetermined condition to control the supply of the power to the machine 1.

The safety operating system S configured as above is configured to stop the operation of the machine 1 when the door 8 is opened by detecting the opening/closing state of the door 8. While the door 8 is opened, it is assumed that the person is within the safety fence 2. As a result, while the door 8 is opened, the safety operating system 1 is configured to stop the operation of the machine 1 to ensure the safety of the person in the safety operating system S.

In the embodiment, the safety operating system S is configured to dually provide the contact points in the apparatuses in terms of assuring the operation of the system and providing a system having high safety even under failures of the apparatuses.

Subsequently, a circuit Ci1 (power supply circuit) in the related art, which controls power supplying at the time of detecting the opening/closing of the door 8 of the safety operating system S described above will be described by using FIG. 2. Further, the relay according to the present invention is applicable to, for example, the electromagnetic relays R1 and R2 and the electromagnetic contactors KM1 and KM2 of the circuit Ci1.

Figure 2:
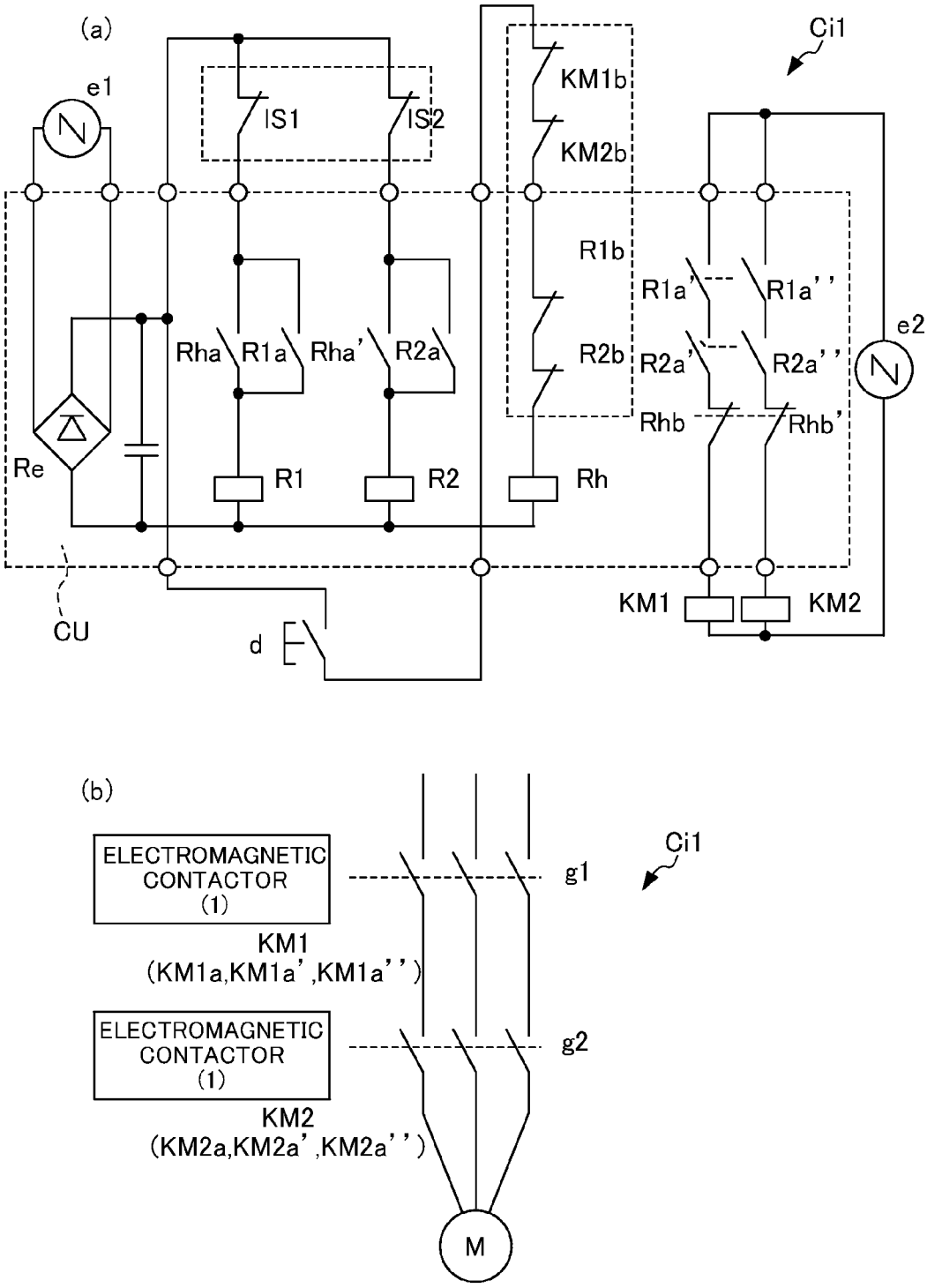
FIG. 2 is a diagram illustrating a power supply circuit in detecting the opening/closing of the door in the safety operating system in the related art.

Further, FIG. 2 illustrates a configuration of a case using the electromagnetic relays R1 and R2 and the electromagnetic contactors KM1 and KM2 in the related art for definite comparison with an application example of the relay according to the present invention. Further, hereinafter, a and b attached to the ends of reference numerals of each of the electromagnetic relays R1, R2, and Rh and each of the electromagnetic contactors KM1 and KM2 denote Contact point a and Contact point b, respectively.

As illustrated in FIGS. 2(*a*) and 2(*b*), the circuit Ci1 includes a first power supply e1, a rectifier Re, a first electromagnetic relay R1, a second electromagnetic relay R2, door switches IS1 and IS2, a third electromagnetic relay Rh, a first electromagnetic contactor KM1, a second electromagnetic contactor KM2, a second power supply e2, a start button d, and a control unit CU serving as a controller.

The first power supply e1 supplies an AC power to the rectifier Re.

The rectifier Re converts the AC power from the first power supply e1 into a DC power.

The first electromagnetic relay R1 includes three Contact points a R1*a*, R1*a*', and R1*a*" and one Contact point b R1*b*.

The second electromagnetic relay R2 includes three Contact points a R2*a*, R2*a*', and R2*a*" and one Contact point b R2*b*.

The door switches IS1 and IS2 are configured by switches which are switched while the door 8 is opened/closed. In the embodiment, when the door 8 is opened, the door switches IS1 and IS2 are cut.

The third electromagnetic relay Rh includes two Contact points a Rha and Rha' and two Contact points b Rhb and Rhb'.

Contact point a R1*a* of the first electromagnetic relay R1 and Contact point a Rha of the third electromagnetic relay Rh are connected to each other in parallel and further, connected to the door switch IS1 in series and supplies the power from the first power supply e1 to the first electromagnetic relay R1. Contact point a R2*a* of the second electromagnetic relay R2 and Contact point a Rha' of the third electromagnetic relay Rh are connected to each other in parallel and further, connected to the door switch IS2 in series and supplies the power from the first power supply e1 to the second electromagnetic relay.

Contact point a R1*a*' of the first electromagnetic relay R1, Contact point a R2*a*' of the second electromagnetic relay R2, and Contact point b Rhb of the third electromagnetic relay Rh are connected to the second power supply e2 to be described below in series and supply a power from the second power supply e2 to the first electromagnetic contactor KM1. Similarly, Contact point a R1*a*' of the first electromagnetic relay R1, Contact point a R2*a*" of the second electromagnetic relay R2, and Contact point b Rhb' of the third electromagnetic relay Rh are connected to the second power supply e2 to be described below in series and supply the power from the second power supply e2 to the second electromagnetic contactor KM2.

The first electromagnetic contactor KM1 includes three Contact points a KM1*a*, KM1*a*', and KM1*a*" and one Contact point b (KM1*b*).

The second electromagnetic contactor KM2 includes three Contact points a KM2*a*, KM2*a*', and KM2*a*" and one Contact point b (KM2*b*).

A power supply circuit to a 3-phase motor is configured so that Contact point a KM1*a* of the first electromagnetic contactor KM1 and Contact point a KM2*a* of the second electromagnetic contactor KM2 are connected to Phase a in series, Contact point a KM1*a*' of the first electromagnetic contactor KM1 and Contact point a KM2*a*' of the second electromagnetic contactor KM2 are connected to Phase b in series, and Contact point a KM1*a*" of the first electromagnetic contactor KM1 and Contact point a KM2*a*" of the second electromagnetic contactor KM2 are connected to Phase c in series.

The start button d transmits a signal to the control unit CU.

The control unit CU collectively controls each of the electromagnetic relays R1 and R2 and each of the electromagnetic contactors KM1 and KM2.

The embodiment is configured to dually include Contact point a. An electromagnetic relay is handled, in which Contact point b is opened while Contact point a is closed and Contact point a is opened while Contact point b is closed.

Contact point a is a contact point which is constantly opened in a non-operating state (a non-excitation state of a solenoid 32). Contact point b used to correspond to Contact point a is a contact point which is constantly closed in the non-operating state (the non-excitation state of the solenoid 32).

Subsequently, a control of the circuit Ci1 will be described by using FIG. 2. The circuit Ci1 executes a control to actuate each of the electromagnetic relays R1, R2, and Rh and each of the electromagnetic contactors KM1 and KM2 under a required condition by using the control unit CU, as illustrated in FIG. 2(*a*).

First, the start button d is pressed by the person to start all operations. Before the start button d is pressed, Contact points a of each of the electromagnetic relays R1, R2, and Rh and each of the electromagnetic contactors KM1 and KM2 are all opened and Contact points b of each of the electromagnetic relays R1, R2, and Rh and each of the electromagnetic contactors KM1 and KM2 are all closed, in a normal state. Further, the door 8 is closed, and as a result, IS1 and IS2 are closed.

The start button is pressed, and as a result, it is verified that Contact points b of the first electromagnetic relay R1, the second electromagnetic relay R2, the first electromagnetic contactor KM1, and the second electromagnetic contactor KM2 are all closed in order to verify whether Contact points a of the first electromagnetic relay R1, the second electromagnetic relay R2, the first electromagnetic contactor KM1, and the second electromagnetic contactor KM2 are normally functioned. When any one Contact point b is opened, Contact point a corresponding to Contact point b is welded to be closed. In this case, since the third electromagnetic relay Rh is not excited and Contact point a of the third electromagnetic relay Rh is not closed, the electromagnetic relays R1 and R2 are not excited, and thus the circuit Ci1 is not configured, and as a result, the power is not supplied to the machine 1.

The control unit CU first controls Contact point a of the third electromagnetic relay Rh to be closed by pressing the start button d, under a condition in which Contact point b of the first electromagnetic relay R1, Contact point b of the second electromagnetic relay R2, Contact point b of the first electromagnetic contactor KM1, and Contact point b of the second electromagnetic contactor KM2 are configured.

Subsequently, the control unit CU controls Contact points a of the door switches IS1 and IS2 to be closed by exciting the first electromagnetic relay R1 and the second electromagnetic relay R2 under a condition in which the contact points a of the door switches IS1 and IS2 are closed.

Subsequently, the control unit CU excites the first electromagnetic contactor KM1 and the second electromagnetic contactor KM2, and controls Contact points a of the electromagnetic contactors to be closed under a condition in which the door switches IS, the first electromagnetic relay R1 and the second electromagnetic relay R2 are configured by self-holding circuits and Contact point b of the third electromagnetic relay Rh is closed.

In this case, the control unit CU controls an order of execution from an opened state to a closed state of Contact point a of the first electromagnetic relay R1 and Contact point a of the second electromagnetic relay R2 in order to ensure high redundancy in the first electromagnetic relay R1.

The power supply circuit to the 3-phase motor illustrated in FIG. 2(*b*) is configured when Contact point a of the first electromagnetic contactor KM1 and Contact point a of the second electromagnetic contactor KM2 are closed.

In this case, the control unit CU controls an order of execution from an opened state to a closed state of Contact point a of the first electromagnetic contactor MK1 and Contact point a of the second electromagnetic contactor KM2 in order to ensure high redundancy in the first electromagnetic contactor KM1.

As a result, in the safety operating system S, a 3-phase motor M serving as a power mechanism of the machine 1 becomes a drivable state as illustrated in FIG. 2(*b*). In this state, the machine 1 becomes operable by operating an operation base.

When the door 8 is opened while the machine 1 is being operated, the door switches IS1 and IS2 are opened, and the first electromagnetic relay R1 and the second electromagnetic relay R2 are in the non-excitation state, and as a result, Contact points a thereof are opened. In this case, although Contact point a of the second electromagnetic relay R2 is subjected to a welding failure by arc discharge, and the like, the first electromagnetic contactor and the second electromagnetic contactor may significantly be in the non-excitation state by Contact point a of the first electromagnetic relay R1.

Further, Contact point a of the first electromagnetic contactor and Contact point a of the second electromagnetic contactor are opened by the non-excitation of the first electromagnetic contactor and the second electromagnetic contactor. In this case, although Contact point a of the second electromagnetic contactor KM2 is subjected to the welding failure by the arc discharge, and the like, the power supply circuit to the 3-phase motor may be significantly interrupted by Contact point a of the first electromagnetic contactor KM1.

Figure 3:
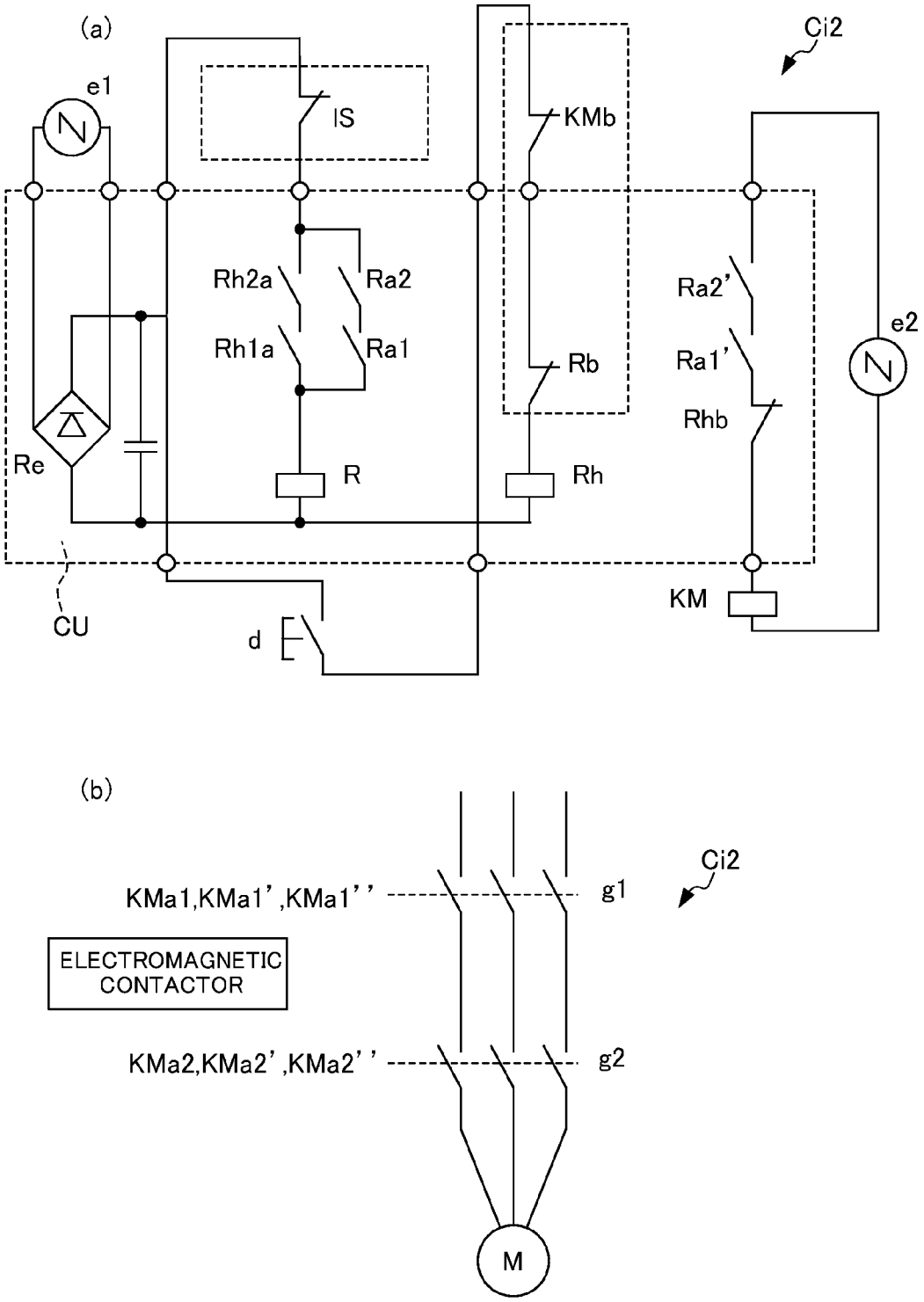
FIG. 3 is a diagram illustrating a power supply circuit in detecting opening/closing of a door in a safety operating system configured by using a relay of the present invention.

The aforementioned circuit Ci1 may be configured by a circuit Ci2 as illustrated in FIG. 3 by using the relay according to the present invention. The same reference numerals as in the circuit Ci1 in the drawings refer to the same components as the aforementioned circuit Ci1 and a description thereof will be omitted.

In the circuit Ci2, by applying the relay according to the present invention, the electromagnetic relays R1 and R2 and the electromagnetic contactors KM1 and KM2 which were used in the circuit Ci1 may be provided as one electromagnetic relay R and one electromagnetic contactor KM, respectively.

In detail, in the circuit Ci2, the electromagnetic relay R is provided instead of the first electromagnetic relay R1 and the second electromagnetic relay R2 of the circuit Ci1, as illustrated in FIG. 3(*a*).

The electromagnetic relay R includes two Contact points a which are operated at different timings (Ra1 and Ra2). One contact point a Ra2 of two contact points a Ra1 and Ra2 is set to have an opening/closing timing different from the other contact point Ra1 so that one Contact point a Ra2 has a high load at all times at the time of opening/closing the contact point.

Two Contact points a Ra1 and Ra2 are operated such that Contact point a Ra2 having the high load is first opened in the opened state and Contact point a Ra2 having the high load is closed later in the closed state because one Contact point a Ra2 has the high load at all times.

Further, the electromagnetic relay R has Contact point b Rb that is operated in synchronization with Contact point a Ra2 having the high load between two Contact points a Ra1 and Ra2.

In addition, the third electromagnetic relay Rh also has the same configuration as the electromagnetic relay R as illustrated in FIG. 3(*a*) and redundancy of the third electromagnetic relay Rh is achieved.

Besides, in the circuit Ci2, the electromagnetic contactor KM is provided in the circuit Ci2 instead of the first electromagnetic contactor KM1 and the second electromagnetic contactor KM2 of the circuit Ci1, as illustrated in FIGS. 3(*a*) and 3(*b*).

The electromagnetic contactor KM has two Contact points a which are operated at different timings similarly as the electromagnetic relay R (KMa1 and KMa2).

One contact point a KMa2 of two Contact points a KMa1 and KMa2 is set to have an opening/closing timing different from the other Contact point a KMa1 so that one Contact point a KMa2 has the high load at all times at the time of opening/closing the contact point, similarly as the electromagnetic relay R. Two Contact points a KMal and KMa2 are operated such that Contact point a KMa2 having the high load is first opened in the opened state and Contact point a KMa2 having the high load is closed later in the closed state because one Contact point a KMa2 has the high load at all times.

Further, the electromagnetic contactor KM has Contact point b KMb that is operated in synchronization with Contact point a KMa2 having the high load between two Contact points a KMa1 and KMa2, similarly as the electromagnetic relay R.

Subsequently, an operation of the circuit Ci2 will be described.

First, Contact points a Rha1 and Rha2 of the third electromagnetic relay Rh are closed by pressing the start button d, under a condition in which Contact point b Rb of the electromagnetic relay R, Contact point b Rhb of the third electromagnetic relay Rh, and Contact point b KMb of the electromagnetic contactor KM are configured and Contact point a of the door switch IS is configured.

Subsequently, Contact points a Ra1, Ra2, Ra1', and Ra2' are closed by exciting the electromagnetic relay R under a condition in which Contact point a of the door switch IS is opened. In this case, in the electromagnetic relay R, Contact points a1 Ra1 and Ra1' are first closed and subsequently, Contact points a2 Ra2 and Ra2' are closed. By this operation, in the electromagnetic relay R, the load is concentrated on Contact points a2 Ra2 and Ra2'.

Subsequently, the electromagnetic contactor KM is excited and Contact points a (KMa1, KMa2, KMa1', KMa2', KMa1", and KMa2") of the electromagnetic contactor KM are closed under a condition in which the door switch IS, the electromagnetic relay R, and the third electromagnetic relay Rh constitutes the self-holding circuits and Contact point b Rhb of the third electromagnetic relay Rh is closed.

The power supply circuit to the 3-phase motor M illustrated in FIG. 3(*b*) is configured when Contact points a (KMa1, KMa2, KMa1', KMa2', KMa1", and KMa2") of the electromagnetic contractor KM are closed. In this case, in the electromagnetic contactor KM, Contact points a1 KMa1, KMa1', and KMa1" are first closed and subsequently, Contact points a2 KMa2, KMa2', and KMa2" are closed. By this operation, in the electromagnetic contactor KM, the load is concentrated on Contact points a2 KMa2, KMa2', and KMa2".

As a result, in the safety operating system S, the 3-phase motor M serving as the power mechanism of the machine 1 becomes the drivable state as illustrated in FIG. 3(*b*).

When the door 8 is opened while the machine 1 is being operated, the door switch IS is opened and the electromagnetic relay R is in the non-excitation state, and as a result, Contact points a Ra1, Ra1', Ra2, and Ra2' are opened. In this case, although Contact points a2 Ra2 and Ra2' are subjected to the welding failure by the arc discharge, and the like, the electromagnetic contactor KM may significantly be in the non-excitation state by Contact point a1.

Further, Contact points a KMa1, KMa2, KMa1', KMa2', KMa1", and KMa2" of the electromagnetic contactor are opened by the non-excitation of the electromagnetic contactor KM. In this case, although Contact points a2 KMa2, KMa2', and KMa2" of the electromagnetic contactor KM are subjected to the welding failure by the arc discharge, and the like, the power supply circuit to the 3-phase motor may be significantly interrupted by Contact points a1 KMa1, KMa1', and KMa1" of the electromagnetic contactor KM.

In the circuit Ci2 configured as above, high redundancy may be ensured even when the contact point breaks down similarly as the circuit Ci1, and in addition, the numbers of the electromagnetic relays R and the electromagnetic contactors KM may be a half as compared with the circuit Ci1. Further, safety may be improved by achieving the redundancy similarly as in the case of the third electromagnetic relay Rh.

Further, the load may be concentrated on the electromagnetic relay R and Contact points a2 KMa2, KMa2', and KMa2" of the electromagnetic contactor KM and Contact points a1 KMa1, KMa1', and KMa1" may be maintained to be the operable state when Contact points a2 KMa2, KMa2', and KMa2" break down.

The relay according to the present invention may be applied to the circuit Ci2 used in the aforementioned safety operating system S instead of each of the electromagnetic relays R1 and R2 or each of the electromagnetic contactors KM1 and KM2. In the circuit Ci2, when the relay according to the present invention is applied, the same control of the supply of the power to the machine 1 may be performed without damaging the safety while reducing a control burden of the control unit CU. Further, since the relay according to the present invention provides a plurality of contact points with one relay, as compared with the circuit Ci1 in the related art, the number of apparatuses associated with the contact points of the electromagnetic contactor KM or the electromagnetic relay R constituting the circuit Ci may be reduced.

Hereinafter, each of the electromagnetic relays R and Rh and the electromagnetic contactor KM used in the aforementioned Ci2 will be described in detail with reference to FIGS. 4 and 5 by using the electromagnetic contactor KM as an example. Further, hereinafter, the components associated with Contact point a1 are attached with A1, the components associated with Contact point a2 are attached with A2, and the components associated with Contact point b2 which is Contact point b corresponding to Contact point a2 are attached with B2 (for example, in the case of a fixed contact piece of Contact point a1, the fixed contact piece is attached with reference numeral 30A1). In this case, when Contact point a1, Contact point a2, and Contact point b2 are common, a reference numeral for identifying each contact point is not attached (for example, in the case of the fixed contact piece of each contact point, the fixed contact piece is attached with only reference numeral 30).

Figure 4:
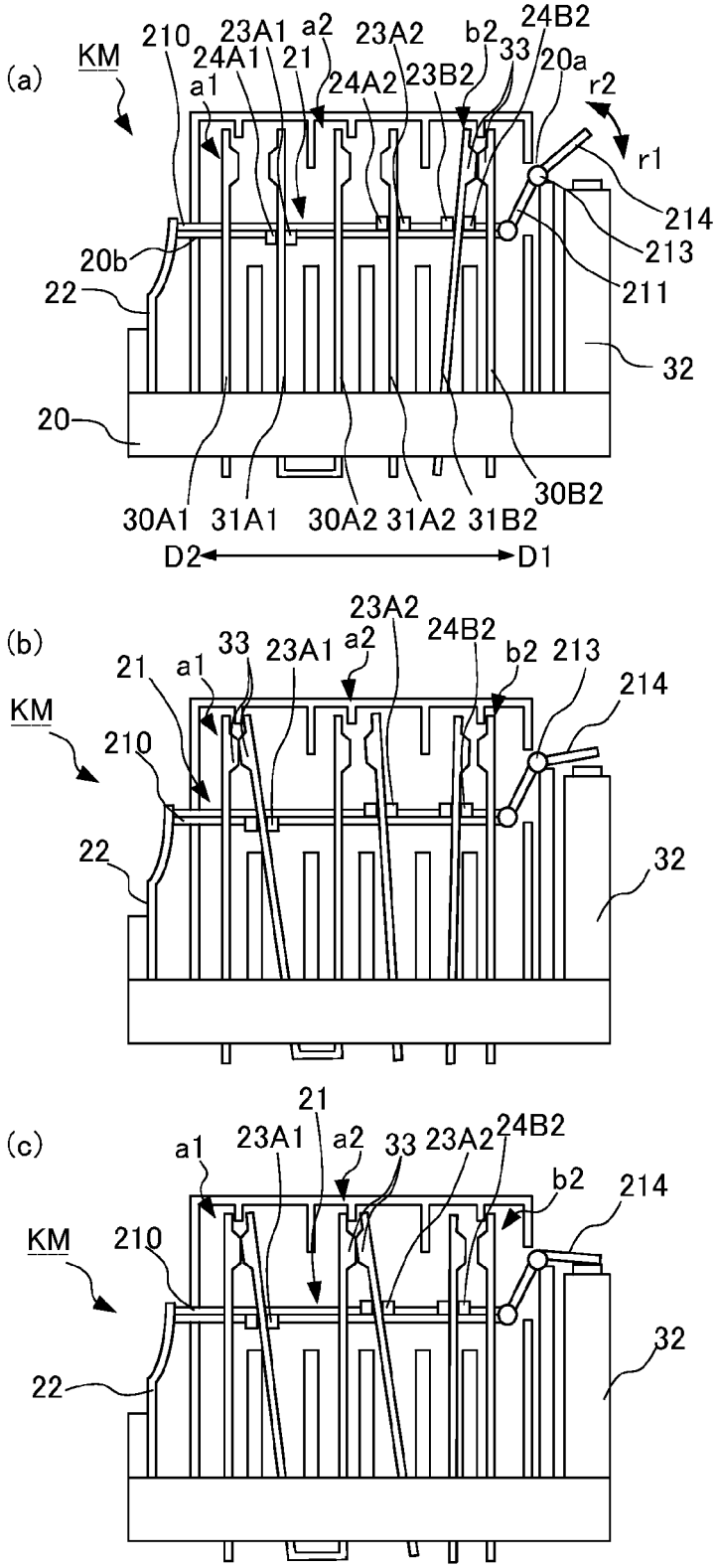
FIG. 4 is a diagram illustrating an electromagnetic contactor which is an embodiment of the relay according to the present invention, (a) is a diagram illustrating a non-excitation state of a solenoid, (b) is a diagram illustrating a moving state of a contact point when the solenoid is excited, and (c) is a diagram illustrating a movement completion state of the contact point when the solenoid is excited.

The electromagnetic contactor KM includes a case 20, Contact points (Contact point a1 a1, Contact point a2 a2, and Contact point b2 b2), a movable piece 21 (power transmission mechanism), a spring 22, and a solenoid 32, as illustrated in FIG. 4(*a*).

The case 20 includes a first opening portion 20*a* and a second opening portion 20*b* at both sides thereof.

Each of Contact points a1, a2, and b2 includes a fixed contact piece 30 and a movable contact piece 31. Each of Contact points a1, a2, and b2 is closed with the fixed contact piece 30 and the movable contact piece 31 being in contact with each other and opened with the fixed contact piece 30 and the movable contact piece 31 being in non-contact with each other.

One end of each of the fixed contact piece 30 and the movable contact piece 31 is positioned inside the case 20 and the other end thereof protrudes outside the case 20. Further, each of the fixed contact piece 30 and the movable contact piece 31 has a terminal portion 33 on one end thereof. The terminal portions 33 are electrically connected to be in contact with each other.

The fixed contact piece 30 and the movable contact piece 31 are placed at predetermined positions (at an interval of 5 mm, in the embodiment) and thus are placed with the terminal portions 33 and 33 facing each other.

Both ends of the fixed contact piece 30 are fixed to the case 20. The movable contact piece 31 is configured in a cantilever shape in which one end thereof is fixed to the case 20 and the other end thereof serves as a free end. As a result, the terminal portion 33 of the movable contact piece 31 may be moved in a direction to contact the terminal portion 33 of the fixed contact piece 30 by external force. In addition, the movable contact piece 31 is returned to an original position by cancelling the external force.

Further, the contact point of the electromagnetic contactor KM in the embodiment serves as Contact point a and Contact point b by setting the positional relationship between a fixed contact piece 30A2 (movable contact piece 31A2) and a fixed contact piece 30B2 (movable contact piece 31B2) opposite to each other in order to configure Contact point a2 a2 and Contact point b2 b2.

In the embodiment, Contact point a2 is configured by placing the fixed contact piece 30A2 at the left side of the figure and the movable contact piece 31A2 at the right side of the figure, as illustrated in FIGS. 4(*a*) to 4(*c*). Further, Contact point b2 is configured by placing the fixed contact piece 30B2 at the right side of the figure and the movable contact piece 31B2 at the left side of the figure, contrary to Contact point a2.

Further, in the electromagnetic contactor KM, Contact point a1 a1 and Contact point a2 a2 are connected to each other in series outside the case 20, as illustrated in FIG. 4(*a*). In addition, in the embodiment, Contact point a1 a1 and Contact point a2 a2 are connected to each other in series outside the case 20, but the present invention is not limited thereto and Contact point a1 a1 and Contact point a2 a2 may be connected to each other in series inside the case 20.

The movable piece 21 is configured with both ends thereof penetrating the first opening portion 20*a* and the second opening portion 20*b* and protruding from the case 20. The movable piece 21 includes a plane portion 210, a first curve portion 211, a shaft portion 213, and a second curve portion 214.

The plane portion 210 is formed in a two-flat plate shape and configured to be movable independently. The movable piece 21 is axially supported on the case 20 by the shaft portion 213.

The movable piece 21 configured as above is rotatably attached to the case 20 by the shaft portion 213 and one end thereof penetrates the first opening portion 20*a*.

As a result, in the movable piece 21, force in a rotational direction r1 which is a clockwise direction is applied to the second curve portion 214 which works when the solenoid 32 serves as an electromagnet, and as a result, rotational force is applied to the plane portion 210 and the first curve portion 211 around the shaft portion 213. In the movable piece 21, the rotational force is applied to move the plane portion 210 in an anti-pressing direction D2 to be described below by using the second opening portion 20*b* as a guide, as illustrated in FIG. 4(*a*).

Further, the movable piece 21 moves the plane portion 210 in a pressing direction D1 to be described below by force of the spring 22 when the solenoid 32 does not serve as the electromagnet.

Press portions 23A1 and 24A1 (first press portion), press portions 23A2 and 24A2 (second press portion), and press portions 23B2 and 24B2 (third press portion) having a protrusion shape are formed in the plane portion 210, which move the movable contact pieces 31A1, 31A2, and 31B2 by the movement of the plane portion 210 to correspond to the movable contact pieces 31A1, 31A2, and 31B2 of the respective Contact points a1, a2, and b2, as illustrated in FIG. 4(*a*).

The press portions 23A1 and 23A2 contact the movable contact pieces 31A1 and 31A2 and move the movable contact pieces 31A1 and 31A2 in the anti-pressing direction D2, with the movement of the plane portion 210 in the anti-pressing direction D2 to be described below, as illustrated in FIGS. 4(*a*) to 4(*c*). Further, the press portions 24A1 and 24A2 contact the movable contact pieces 31A1 and 31A2 and move the movable contact pieces 31A1 and 31A2 in the pressing direction D1, with the movement of the plane portion 210 in the pressing direction D1.

The press portion 24B2 contacts the movable contact piece 31B2 and moves the movable contact piece 31B2 in the anti-pressing direction D2, with the movement of the plane portion 210 in the anti-pressing direction D2, as illustrated in FIGS. 4(*a*) to 4(*c*). Further, the press portion 23B2 contacts the movable contact piece 31B2 and moves the movable contact piece 31B2 in the pressing direction D1, with the movement of the plane portion 210 in the pressing direction D1.

That is, the press portions 23A1, 23A2, and 23B2 move the movable contact pieces 31A1, 31A2, and 31B2 with the configured contact point being closed. Further, the press portions 24A1, 24A2, and 24B2 move the movable contact pieces 31A1, 31A2, and 31B2 with the configured contact point being opened.

In the embodiment, the opening/closing states of Contact point a1 a1 and Contact point a2 a2 are changed at different timings. In the embodiment, as illustrated in FIG. 5(*a*), when each of Contact points a a1 and a2 is changed from the opened state to the closed state, Contact point a1 a1 is first closed and subsequently, Contact point a2 a2 is closed.

Further, when each of Contact points a a1 and a2 is changed from the closed state to the opened state, Contact point a2 a2 is first opened and subsequently, Contact point a1 a1 is opened. By this configuration, a failure element is concentrated on Contact point a2 a2 by applying an electric contact load to Contact point a2 a2 at all times.

Therefore, even when Contact point a2 a2 having the high load breaks down, Contact point a1 a1 has a low load at all times, and as a result, an operation up to replacement of Contact point a2 a2 is just assured and an operation which is durable to the use is just performed, thereby improving operation reliability as the apparatus.

Contact point b2 b2 is provided with respect to Contact point a2 a2 having the high load and the failure in Contact point a2 a2 may be judged.

In the electromagnetic contactor KM, placement of the movable contact piece 31A1 and the press portions 23A1 and 24A1 and the movable contact piece 31A2 and the press portions 23A2 and 24A2 is determined so that Contact point a1 a1 and Contact point a2 a2 are operated at the aforementioned timings according to setting a relative shape of the movable piece 21.

Figure 5:
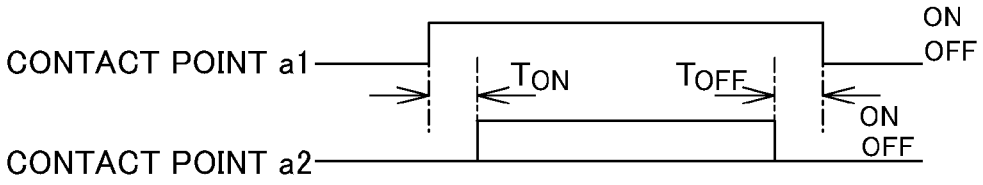
FIG. 5 is a diagram describing an opening/closing timing of the contact point, (a) is a diagram illustrating opening/closing timings of Contact point a1 and Contact point a2, (b) is a diagram illustrating the relationship between movable contact pieces and press portions of Contact point a1 and Contact point a2 in the state of FIG. 4(*a*), and (c) is a diagram illustrating the relationship between a movable contact piece and a press portion of Contact point b2 in the state of FIG. 4(*a*).
Figure 5:
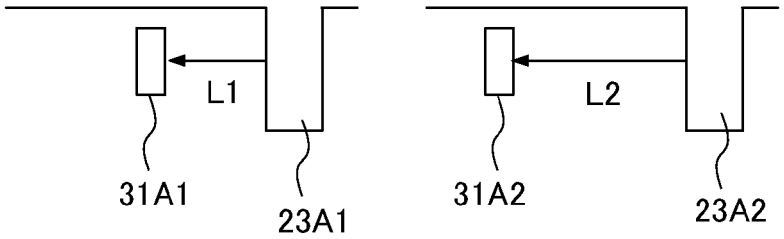
Figure 5:
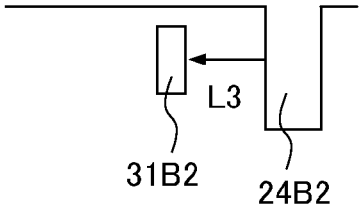

For example, placement of the movable contact piece 31A1 and the press portion 23A1 and the movable contact piece 31A2 and the press portion 23A2 is set so that the movable contact piece 31A2 and the press portion 23A2 are placed at a position to be spaced apart from each other by a distance L2 longer than a distance L1 between the movable contact piece 31A1 and the press portion 23A1 in a pressing state of the spring 22 (the non-excitation state of the solenoid 32), as illustrated in FIG. 5(*b*) in the embodiment. The press portions 24A1 and 24A2 are also set to be placed in the same viewpoint as the press portions 23A1 and 23A2.

By this configuration, in the electromagnetic contactor KM, since the press portion 23A1 contacts the movable contact piece 31A1 to make Contact point a1 a1 be in the contact state earlier than the case where the press portion 23A2 contacts the movable contact piece 31A2 to make Contact point a2 a2 be in the contact state by the movement of the movable piece 21, Contact point a1 a1 is closed earlier than Contact point a2 a2. In this case, Contact point a2 a2 is closed later than Contact point a1 a1, and as a result, the electric conduction is achieved such that the electric load is applied to Contact point a2 a2.

Further, in the electromagnetic contactor KM, since the press portion 24A2 contacts the movable contact piece 31A2 to make Contact point a2 a2 be in the non-contact state (separation state) earlier than the case where the press portion 24A1 contacts the movable contact piece 31A1 to make Contact point a1 a1 be in the non-contact state (separation state) by the movement of the movable piece 21, Contact point a2 a2 is opened earlier than Contact point a1 a1. In this case, Contact point a2 a2 is opened earlier than Contact point a1 a1, and as a result, the electric conduction is cancelled such that the electric load is applied to Contact point a2 a2.

Further, Contact point b2 b2 serves as a so-called forcing guide contact point that is operated such that the opening/closing state thereof is opposite to that of Contact point a2 a2. The forcing guide contact point is a contact point which is configured so that Contact point a and Contact point b corresponding thereto are not operated simultaneously. As a standard associated with a self monitoring relay, when Contact point a is welded, Contact point b is configured to maintain a predetermined contact gap (for example, 0.5 mm or more) and when Contact point b is welded, Contact point a is configured to maintain a predetermined contact gap (for example, 0.5 mm or more). By this configuration, when one contact point is welded, it may be detected that one contact point is welded at the other contact point.

In the embodiment, for the aforementioned configuration, Contact point b2 b2 is operated in synchronization with Contact point a2 a2 and the opening/closing state thereof is operated to be opposite to that of Contact point a2 a2.

In detail, when Contact point b2 b2 is changed from the closed state to the opened state earlier than Contact points a a1 and a2 when Contact points a a1 and a2 are changed from the opened state to the closed state and Contact point b2 b2 is changed from the opened state to the closed state later than Contact points a a1 and a2 when Contact points a a1 and a2 are changed from the closed state to the opened state.

For example, the press portion 24B2 is placed at a position (distance L3) where the positional relationship is considered so that the press portion 24B2 is operated earlier than the movable contact pieces 31A1 and 31A2 and the press portions 23A1 and 23A2 when Contact point b2 b2 is closed, as illustrated in FIG. 5(*c*) (in the embodiment, the distance L3 is set to be shorter than the distances L1 and L2 as illustrated in FIG. 5(*c*)).

That is, the press portion 24B2 is placed at a position to contact the movable contact piece 31B2 so that Contact point b2 b2 is opened, that is, the movable contact piece 31B2 is in the non-contact state (separation state) when Contact point a2 a2 is closed. The press portion 23B2 is placed in the same viewpoint as the press portion 24B2.

Further, the displacement of each of the press portions 23A1, 23A2, and 23B2 is determined by considering a movement amount and a movement velocity of the movable piece 21 by movement timings of Contact point a1 a1 and Contact point a2 a2.

In the electromagnetic contactor KM configured as above, since the operation of the movable contact piece 31 is controlled by the press portion 23 placed to correspond to the timing, it is possible to significantly determine the operation of the movable contact piece 31 as a physical structure. In this viewpoint, in the electromagnetic contactor KM, an operating order of the contact points may be controlled in a simple pattern as compared with a case in which the movable contact piece 31 is operated by a signal, and the like.

Further, a plurality of electromagnetic contactors are required in the related art to control the operating order of the contact points, but according to the embodiment, the operating order may be controlled by using one electromagnetic contactor.

Further, in the electromagnetic contactor KM, the press portion 23A2 corresponding to Contact point a2 b2 is placed at a position separated by a distance between the press portion 23A1 corresponding to Contact point a1 a1 and Contact point a1 a1. As a result, in the electromagnetic contactor KM, although Contact point a1 a1 and Contact point a2 a2 are moved at the same level with the movement of the movable piece 21, Contact point a1 a1 and Contact point a2 a2 may be operated at different timings.

Further, in the electromagnetic contactor KM, since the movable piece 21 is configured by an additional plate material, Contact point a1 a1 and Contact point a2 a2 may be operated independently. As a result, in the electromagnetic contactor KM, even when Contact point a2 a2 is subjected to an operational error due to contact point welding, and the like, Contact point a1 a1 may be operated.

The spring 22 has one end thereof fixed to the case 20 to have the cantilever shape. Further, the spring 22 presses the plane portion 210 in the pressing direction D1 and presses the first curve portion 211 in a rotational direction r2, in the movable piece 21.

The solenoid 32 is excited to serve as the electromagnet. The solenoid 32 serves as the electromagnet to suction and adsorb the second curve portion 214 (rotates the second curve portion 214 in the rotational direction r1). In the electromagnetic contactor KM, the second curve portion 214 is suctioned and adsorbed, and as a result, the solenoid 32 is excited. Therefore, the plane portion 210 is moved in the anti-pressing direction D2 which is opposite to the pressing direction D1 of the spring 22.

Meanwhile, when the excitation state of the solenoid 32 is cancelled, the second curve portion 214 is rotated in the rotational direction r2 and the plane portion 210 is moved in the pressing direction D1, by the pressing force of the spring 22.

Subsequently, an operation of each of Contact points a1, a2, and b2 will be described by using FIGS. 4(*a*) to 4(*c*).

In the electromagnetic contactor KM, the pressing force in the pressing direction D1 from the spring 22 works in the non-excitation state of the solenoid 32, as illustrated in FIG. 4(*a*).

As a result, Contact point a1 a1 is pressed by the press portion 24A1 in the pressing direction D1 and thus is opened.

In detail, in Contact point a1 a1, the press portion 24A1 presses the movable contact piece 31A1 in the pressing direction D1, and the fixed contact piece 30A1 and the movable contact piece 31A1 are in non-contact with each other, as illustrated in FIG. 4(*a*).

Further, Contact point a2 a2 is pressed by the press portion 24A2 in the pressing direction D1 and thus is opened, similarly as Contact point a1 a1.

In detail, in Contact point a2 a2, the press portion 24A2 presses the movable contact piece 31A2 in the pressing direction D1, and the fixed contact piece 30A2 and the movable contact piece 31A2 are in non-contact with each other, as illustrated in FIG. 4(*a*).

Further, Contact point b2 b2 is pressed by the press portion 23B2 and thus is closed, as illustrated in FIG. 4(*a*).

In detail, in Contact point b2 b2, the movable contact piece 31B2 is pressed by the press portion 23B2 in the pressing direction D1, and thus the fixed contact piece 30B2 and the movable contact piece 31B2 are in contact with each other, as illustrated in FIG. 4(*a*).

Subsequently, in the electromagnetic contactor KM, when the solenoid 32 is excited (in detail, when the second curve portion 214 is suctioned), the movable piece 21 is first moved in the anti-pressing direction D2, which is opposite to the pressing direction D1, against the pressing force in the pressing direction D1 from the spring 22, as illustrated in FIG. 4(*b*).

In this case, Contact point a1 a1 is closed by the press portion 23A1.

In detail, in Contact point a1 a1, the movable contact piece 31A1 is pressed by the press portion 23A1 in the anti-pressing direction D2, and thus the fixed contact piece 30A1 and the movable contact piece 31A1 are in contact with each other, as illustrated in FIG. 4(*b*).

Further, Contact point a2 a2 is moved from the opened state to the closed state by the press portion 23A2, as illustrated in FIG. 4(*b*).

In detail, in Contact point a2 a2, the movable contact piece 31A2 is pressed by the press portion 23A2 in the anti-pressing direction D2, and thus the movable contact piece 31A2 is moved in a direction to contact the fixed contact piece 30A2, as illustrated in FIG. 4(*b*).

Further, Contact point b2 b2 is opened by the press portion 23B2, as illustrated in FIG. 4(*b*).

In detail, in Contact point b2 b2, the press portion 23B2 moves in the anti-pressing direction D2 of the movable contact piece 31B2, and thus the fixed contact piece 30B2 and the movable contact piece 31B2 are in non-contact with each other, as illustrated in FIG. 4(*b*).

Further, in the embodiment, Contact point b2 b2 is operated earlier than Contact point a1 a1 and Contact point a2 a2 to be opened. Meanwhile, when the closed state is executed, Contact point b2 b2 is operated later than Contact point a1 a1 and Contact point a2 a2 to be closed.

In addition, in the electromagnetic contactor KM, when a new solenoid 32 is excited (in detail, when the second curve portion 214 is adsorbed), the movable piece 21 is further moved in the anti-pressing direction D2, which is opposite to the pressing direction D, against the pressing force in the pressing direction D1 from the spring 22, as illustrated in FIG. 4(*c*).

Contact point a1 a1 is closed subsequently to FIG. 4(*b*).

In detail, in Contact point a1 a1, the movable contact piece 31A1 of Contact point a1 a1 is pressed by the press portion 23A1 corresponding to Contact point a1 a1 in the anti-pressing direction D2, and the fixed contact piece 30A1 and the movable contact piece 31A1 are in contact with each other, as illustrated in FIG. 4(*b*).

Further, Contact point a2 a2 is closed by the press portion 23A2, as illustrated in FIG. 4(*c*).

In detail, in Contact point a2 a2, the movable contact piece 31A2 is pressed by the press portion 23A2 in the anti-pressing direction D2, and thus the fixed contact piece 30A2 and the movable contact piece 31A2 are in contact with each other, as illustrated in FIG. 4(*c*).

Further, Contact point b2 b2 is opened by the press portion 23B2 subsequently to FIG. 4(*b*), as illustrated in FIG. 4(*c*).

In the electromagnetic contactor KM, when Contact points a a1 and a2 are changed from the opened state to the closed state, Contact point b2 b2 is first opened and subsequently, Contact point a1 a1 is closed and finally, Contact point a2 a2 is closed.

Further, in the electromagnetic contactor KM, the solenoid 32 is changed to the non-excitation state from the state (the excitation state of the solenoid 32) illustrated in FIG. 4(*c*), and as a result, first, Contact point a2 a2 is in the non-contact state (opened state) and Contact point b2 b2 is in the contact state (closed state).

Subsequently, in the electromagnetic contactor KM, Contact point a1 is in the non-contact state (opened state). In detail, when suction force of the solenoid 32 disappears, the movable piece 21 is moved by the pressing force of the spring 22 in the pressing direction D1. As a result, Contact point a1 a1 and Contact point a2 a2 are in non-contact with each other (opened state) by the movement of the press portions 24A1 and 24A2 in the pressing direction D1 with respect to the movable contact pieces 31A1 and 31A2.

In this case, since the movable contact piece 31A2 and the movable contact piece 31A2 in this order work on Contact point a1 a1 and Contact point a2 a2 by the movement of the press portions 24A2 and 24A1 in the pressing direction D1, Contact point a2 a2 is first in the non-contact state (opened state) and subsequently, Contact point a1 a1 is in the non-contact state (opened state).

Further, Contact point b2 b2 is in the contact state (closed state) by the movement of the press portion 23B2 in the pressing direction D1 with respect to the movable contact piece 31B2. In this case, Contact point b2 b2 is closed later than Contact points a a1 and a2.

In the electromagnetic contactor KM, when Contact points a a1 and a2 are changed from the closed state to the opened state, Contact point a2 a2 is first opened and subsequently, Contact point a1 a1 is opened and finally, Contact point b2 b2 is closed.

The electromagnetic contactor KM configured as above may achieve the following effects.

In the electromagnetic contactor KM, Contact point a1 and Contact point a2 may be operated at different timings by the press portions 23A1, 23A2, 24A1, and 24A2 only by exciting the solenoid 32.

In this case, in the electromagnetic contactor KM, Contact point a2 is in the contact state (closed state) later than Contact point a1 and in the non-contact state (opened state) earlier than Contact point a1 to improve the operation reliability.

Further, in the electromagnetic contactor KM, since the movable contact pieces 31A1 and 31A2 are operated by moving the movable piece 21 with electromagnetic force of the solenoid 32, respective Contact points a1 and a2 may be controlled at different timings in a simple structure.

Further, in the electromagnetic contactor KM, the press portions 23A1 and 24A1 corresponding to Contact point a1 a1 and the press portions 23A2 and 24A2 corresponding to Contact point a2 a2 are provided in the separately formed plane portion 210 and for example, even when Contact point a2 a2 is welded by the arc discharge, and the like, Contact point a1 a1 may be significantly operated.

Further, by using the aforementioned electromagnetic contactor KM in the power supply circuit Ci2, the plurality of contact points are operated independently, and thus the contact points may be significantly controlled by the other contact point although one contact point breaks down. In the control, two independent relays were required to control the operating order of different contact points in the related art, but the control may be performed by using one relay in the relay having the first and second press portions formed in different members of the present invention.

Further, by using the aforementioned electromagnetic contactor KM in the power supply circuit Ci2, since the plurality of contact points may be operated at different timings by excitation of one solenoid 32, a complicated control is not required. Further, since different timings are mechanically assured, the timings of the contact points are not changed by a misoperation of a controller or the like and the contact points may be significantly operated at different timings.

In addition, since the number of the electromagnetic contactors KM or the electromagnetic relays R may be reduced to a half as compared with the related art, simplification or low-cost of the power supply circuit Ci2 may be achieved.

As set forth above, the appropriate embodiments of the electromagnetic contactor KM and the electromagnetic relay R as the relays according to the present invention, and the power supply circuit Ci2 adopting the relays of the present invention have been described, but the present invention is not limited thereto. The present invention is not limited to the embodiment described above and may be implemented by various embodiments.

Further, in the embodiment, the example in which three contact points are provided in one electromagnetic contactor KM has been described, but the present invention is not limited thereto. Two or four or more contact points may be formed. Further, in the electromagnetic contactor KM, the contact points are not operated only at different timings, but the respective contact points may be configured to be operated at desired timings. In addition, the electromagnetic contactor KM may be configured to operate the contact points at the desired timings and not to operate the plurality of contact points independently.

Further, in the embodiment, Contact points a are configured to be operated at different timings, but the present invention is not limited thereto. Plural Contact points b or c may be operated at different timings. Further, Contact point c is called a transfer and allows current to flow to switch the contact point.

Further, in the embodiment, the press portions 23A1, 23A2, 23B2, 24A1, 24A2, and 24B2 are provided in the plane portion 210 in a protrusion shape, but the present invention is not limited thereto. The press portions 23A1, 23A2, 23B2, 24A1, 24A2, and 24B2 are preferably configured to operate the movable contact pieces 31A1, 31A2, and 31B2 by the movement of the movable piece 21 and for example, the plane portion 210 may have a notch shape.

Further, in the embodiment, the second curve portion 214 is suctioned by magnetic force of the solenoid 32 to move the press portion 23, but the present invention is not limited thereto. The press portion 23 is preferably moved by power from a power mechanism and for example, the press portion 23 is preferably moved by directly applying or converting the power with the motor which rotates or the solenoid 32 which linearly moves.

Further, in the embodiment, the contact and separation timings when Contact point a2 contacts the contact point or separated from the contact point earlier than Contact point a1 are provided, but the present invention is not limited thereto. The movement timings of Contact point a1 and Contact point a2 may be set variously and for example, timings only in contact or only in separation may be set differently.

In addition, in the embodiment, the non-contact state between the movable contact piece and the fixed contact piece is configured to be restored to an original position, but the present invention is not limited thereto and the contact state may be configured to be restored to the original position. In this case, the press portion is provided at a corresponding side.

Further, in the embodiment, in the circuit Ci2, respective Contact points a are configured to be connected in series, but the present invention is not limited thereto, and Contact points a may be connected in various patterns according to a set-up of the circuit, and for example, may be configured to be connected in parallel. In addition, in the embodiment, in the circuit Ci2, the example using the plurality of electromagnetic relays and electromagnetic contactors is described, but the present invention is not limited thereto, and various configurations may be adopted according to the set-up of the circuit, and for example, the circuit may be configured by one electromagnetic relay or electromagnetic contractor.

Further, in the embodiment, in the circuit, the relay and the electromagnetic contactor are used in the power supply circuit controlling supplying power, but the present invention is not limited thereto and the relay and the electromagnetic contactor may be used in various control circuits.

EXPLANATION OF REFERENCE NUMERALS

1: Machine (control target)
21: Movable piece (power transmission mechanism)
22: Spring (power mechanism)
23A1, 24A1: Press portion (first press portion)
23A2, 24A2: Press portion (second press portion)
23B2, 24B2: Press portion (third press portion)
30A1, 30A2, 30B2: Fixed contact piece
31A1, 31A2, 31B2: Movable contact piece
32: Solenoid (electromagnet)
a1: Contact point a1 (first contact point)
a2: Contact point a2 (second contact point)
b2: Contact point b2 (third contact point)
Ci2: Power supply circuit (control circuit)
CU: Control unit (controller)
KM: Electromagnetic contactor (relay)

The invention claimed is:

1. A relay, comprising:

a first contact point including a first fixed contact piece and a first movable contact piece;

a second contact point including a second fixed contact piece and a second movable contact piece;

an electromagnet;

a power transmission mechanism operated by the electromagnet configured to cause the first and second movable contact pieces to move; and a spring configured to bias the power transmission mechanism such that the power transmission mechanism is movable oppositely to a direction in which the electromagnet causes the power transmission mechanism to move, wherein the power transmission mechanism includes:

a first press portion driven by the electromagnet configured to come in contact with and to cause the first movable contact piece to move, and a second press portion, which is formed by a different member from the first press portion and driven by the electromagnet, configured to come in contact with and to cause the second movable contact piece to move, and wherein an interval between a portion of the second press portion which comes in contact with the second movable contact piece and the second fixed contact piece is set larger than an interval between a portion of the first press portion which comes in contact with first movable contact piece and the first fixed contact piece, the first contact point closes first and the second contact point closes second, for a case where the first and second press portions operated by the electromagnet cause the first and second contact points to close, respectively, and the second contact point opens first and the first contact point opens second, for a case where the first and second press portions operated by the spring cause the first and second contact points to open, respectively, such that an amount of electric load is applied more to the second contact point than to the first contact point.

2. The relay of claim 1, further comprising:

a third contact point including a third fixed contact piece and a third movable contact piece, wherein the second press portion is configured to cause the third movable contact piece to move so as to:

set the third contact point to close when the second contact point is open; and set the third contact point to open when the second contact point is closed, such that the third contact point is open when the second movable contact piece is fused with the second fixed contact piece.

3. A control circuit controlling a control target by using a relay, wherein:

the relay is the relay of claim 1, and the relay is allocated to the control of the control target.

4. A method for controlling a control circuit which controls a control target by controlling a relay by a control unit, wherein:

the relay is the relay of claim 1, and the relay is allocated to the control of the control target.

* * * * *